US006948997B2

(12) United States Patent
Gregory

(10) Patent No.: US 6,948,997 B2
(45) Date of Patent: Sep. 27, 2005

(54) ELASTIC DRIVE MOTOR WITH FORCE ISOLATION

(76) Inventor: Ivan D. Gregory, 6700 E. 72nd Ave., #3, P.O. Box 682, Commerce City, CO (US) 80022

( * ) Notice: Subject to any disclaimer, the term of this patent is extended or adjusted under 35 U.S.C. 154(b) by 22 days.

(21) Appl. No.: 10/788,950

(22) Filed: Feb. 27, 2004

(65) Prior Publication Data

US 2005/0191931 A1 Sep. 1, 2005

(51) Int. Cl.[7] ..... A63H 27/00
(52) U.S. Cl. ..... 446/60; 446/232
(58) Field of Search ..... 446/57, 59, 60, 446/36, 68, 34, 88, 232

(56) References Cited

U.S. PATENT DOCUMENTS

| | | | | |
|---|---|---|---|---|
| 996,061 A | | 6/1911 | Clarke | |
| 1,507,192 A | | 9/1924 | Laukandt | |
| 2,275,645 A | * | 3/1942 | Perron | 185/39 |
| 3,222,816 A | | 12/1965 | Effinger et al. | |
| 3,251,154 A | * | 5/1966 | Taylor | 446/76 |
| 3,594,946 A | | 7/1971 | DeWitt Jr. | |
| 3,633,306 A | | 1/1972 | Conover | |
| 3,713,249 A | * | 1/1973 | Goodman | 446/162 |
| 3,724,123 A | | 4/1973 | Lemelson | |
| 3,757,461 A | | 9/1973 | Chang et al. | |
| 3,787,997 A | | 1/1974 | Lemelson | |
| 4,198,779 A | | 4/1980 | Kress | |
| 4,271,629 A | | 6/1981 | Goodwin | |
| 4,318,455 A | * | 3/1982 | Lapierre | 185/39 |
| 4,629,438 A | | 12/1986 | McAneny | |
| 4,895,541 A | * | 1/1990 | Miller | 446/57 |
| 5,390,763 A | | 2/1995 | Liedtke | |
| 5,395,275 A | * | 3/1995 | Johnson et al. | 446/60 |
| 5,525,087 A | | 6/1996 | Chin-Lin | |
| 5,749,761 A | * | 5/1998 | Kim | 446/60 |

FOREIGN PATENT DOCUMENTS

| | | |
|---|---|---|
| JP | 8098961 | 4/1996 |
| WO | WO 89/04707 | 6/1989 |

* cited by examiner

*Primary Examiner*—Bena Miller
(74) *Attorney, Agent, or Firm*—Cochran Freund & Young LLC; Paul M. Thompson

(57) ABSTRACT

Disclosed is a method and system for providing an elastic drive mechanism in which the compressive force and torque created by the twisting of an elastic member used to power an aircraft are isolated from the fuselage, and specifically isolated from the flight control and aerodynamics surfaces of the aircraft. By isolating the elastic drive mechanism from traditional rearward fixed contact points on the fuselage, the detrimental consequences of these elastic forces are eliminated producing longer, farther and more controlled flights.

15 Claims, 5 Drawing Sheets

ELASTIC DRIVE MOTOR WITH FORCE ISOLATION

BACKGROUND OF THE INVENTION

1. Field of the Invention

The present invention relates to elastic drive mechanisms and more specifically to a method and apparatus for isolating the forces of elastic drive motors from adversely influencing the propulsion of a vehicle.

2. Description of the Background

Elastic drive motors have been used extensively in the propulsion of a variety of vehicles. Specifically, long elastic members or rubber bands have been employed to store potential energy and later provide propulsion in model airplanes. This propulsion or drive typically involves attaching one end of an elastic member to a propeller which is fixed by a bearing in the nose of the aircraft, and attaching the other end of the elastic member to a contact point on the fuselage towards the tail of the aircraft. As the propeller is rotated in the opposite direction for flight, the elastic member is twisted and energy is thus stored. Since longer flights are desired, particularly in time-of-flight and distance competitions, the rubber bands are usually wound to their elastic limit. This places a significant amount of force in the form of compression, as well as torque, on both ends of the entertainers of the elastic member.

SUMMARY OF THE INVENTION

The present invention overcomes the disadvantages and limitations of the prior art by providing a system and method of use by which the compressive force and torque created by the twisting of an elastic member used to power an aircraft are isolated from the fuselage, and specifically isolated from the flight control and aerodynamics surfaces of the aircraft.

The present invention may therefore comprise a system that isolates internal forces from adversely influencing propulsion of a vehicle comprising: an elastic member for storing potential energy for later use as rotational kinetic energy; a front retainer for retaining a forward end of the elastic member; a drive shaft connected to the front retainer that transmits rotation of the front retainer to the drive shaft; a drive shaft bearing within the front retainer that retains the drive shaft and allows rotation of the drive shaft; a rear retainer for retaining a rearward end of the elastic member; and, a motor isolation span that spans the length of the elastic member and rigidly retains the front retainer near a forward terminus and the rear retainer near an opposing rearward terminus to restrain compressive and torsional forces created by the elastic member during the storing of the potential energy and the release as rotational kinetic energy.

The present invention may also comprise a model aircraft powered by a system that isolates the internal forces from adversely influencing aerodynamics of the model aircraft comprising: a model aircraft; and, an elastic drive motor within the model aircraft comprising: a rubber band for storing potential energy for later use as rotational kinetic energy comprising; a front retainer for retaining a forward end of the rubber band; a drive shaft connected to the front retainer that transmits rotation of the front retainer to the drive shaft; a drive shaft bearing within the front retainer that retains the drive shaft and allows rotation of the drive shaft; a rear retainer for retaining a rearward end of the rubber band; and, a motor isolation span that spans the length of the rubber band and rigidly retains the front retainer near a forward terminus and the rear retainer near an opposing rearward terminus to restrain compressive and torsional forces created by the rubber band when twisted to store the potential energy and when released as rotational kinetic energy to rotate a propeller that provides thrust for the propulsion of the model aircraft.

The present invention may also comprise a method of propelling a vehicle with an elastic drive motor that isolates internal forces from adversely influencing movement of the vehicle comprising the steps of: retaining a forward end of an elastic member with a front retainer that is connected to a drive shaft; transmitting rotation of the front retainer to the drive shaft; retaining a rearward end of the elastic member with a rear retainer; retaining the drive shaft with a drive shaft bearing within the front retainer that allows rotation of the drive shaft; rigidly retaining the front retainer near a forward terminus of a motor isolation span and the rear retainer near an opposing a rearward terminus of the motor isolation span that spans the length of the elastic member; storing potential energy by twisting the elastic member; isolating compressive and torsional forces with the motor isolation span that are created by restraining the elastic member; releasing the potential energy of the elastic member as rotational kinetic energy to propel the vehicle; and, isolating compressive and torsional forces from with the motor isolation span created by releasing the elastic member and producing the rotational kinetic energy.

Advantages of the various embodiments of the present invention include, but not by way of limitation or restriction of the claims, the ability of providing an elastic drive mechanism in which torque created by the twisting of the elastic member is isolated from the fuselage and specifically isolated from the flight control and aerodynamic surfaces of the aircraft. This eliminates the problem in model aircraft flight where the resulting torsional forces produced by retaining a wound rubber band, are transferred through lightweight structural components causing a distortion to the flight control surfaces and producing adverse flight characteristics in the model. The detailed embodiments therefore, produce longer, farther and more controlled flights. The independent or modular component design of the motor assembly also allows a user to easily remove, adjust, replace or repair subcomponents as well as swap out complete motors when needed.

DETAILED DESCRIPTION OF THE INVENTION

Figure 1:
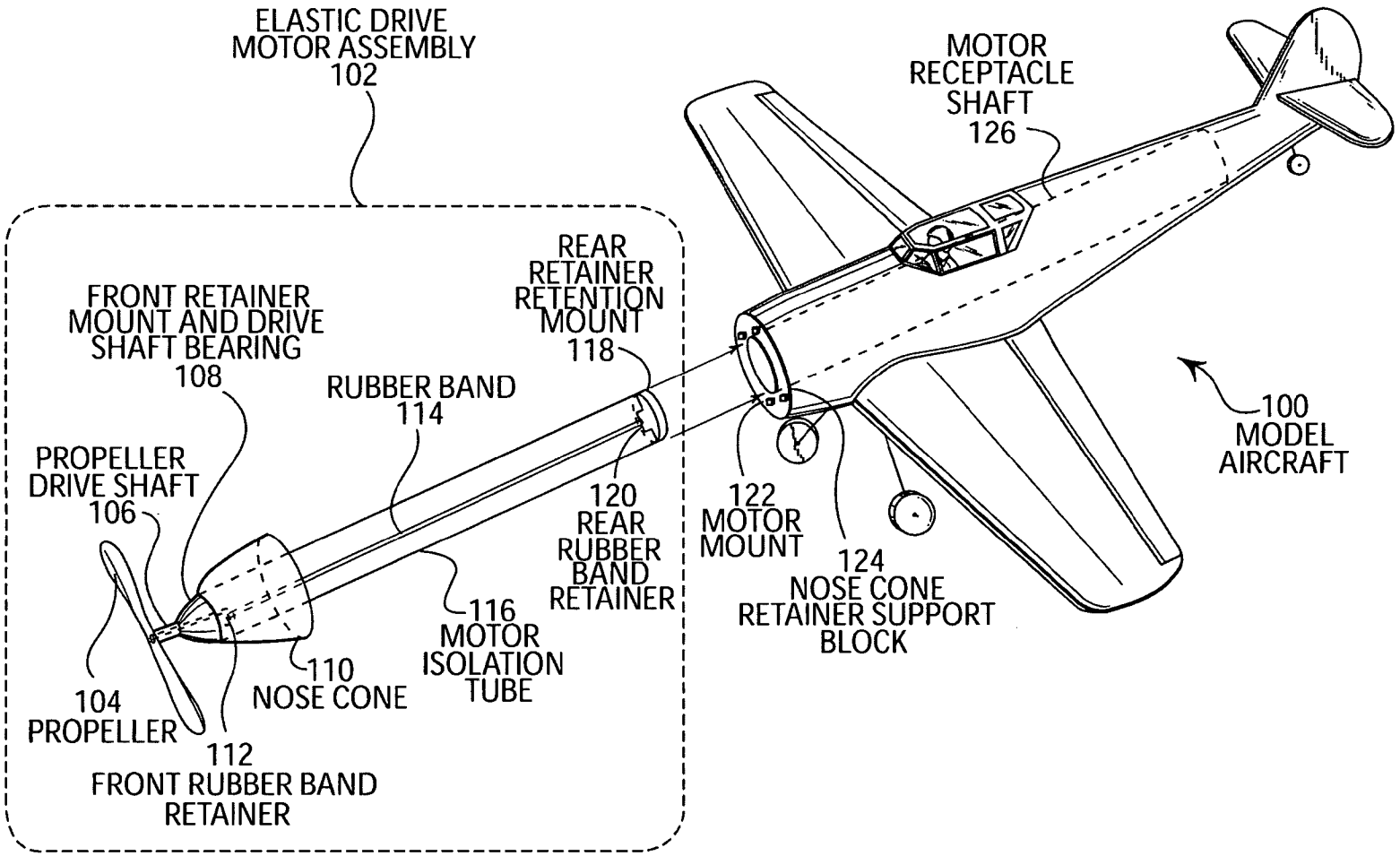
FIG. 1 illustrates an embodiment of a torque isolating elastic drive mechanism in a model aircraft application.

While this invention is susceptible to embodiment in many different forms, there is shown in the drawings and will be described herein in detail specific embodiments thereof with the understanding that the present disclosure is to be considered as an exemplification of the principles of the invention and is not to be limited to the specific embodiments described.

FIG. 1 illustrates an embodiment of a torque isolating elastic drive mechanism in a model aircraft application. In model airplane flight, the wound propeller is usually kept from rotating by the user's hand or by a retaining device until the aircraft is launched. The other end of the rubber band is held rigidly at a contact point on the tail end of the aircraft. This rear contact point must apply a resistive force equal to the amount of compression and torque applied to it by the elastic member. These resistive forces are therefore transferred to the fuselage and ultimately to the flight control surfaces of the aircraft. Due to the lightweight nature of these models, these resistive forces can significantly influence flight characteristics. Additionally, the amount of energy that can be produced by a rubber band powered drive mechanism is very limited. Therefore, model airplane applications necessitate very lightweight and aerodynamically sound designs in order to attain controlled flight. These structural conditions magnify the susceptibility of aircraft designs to adverse effects of warpage and distortion from internal and external forces. The primary adverse internal forces placed upon an elastic drive model aircraft are from retaining the fixed end of the elastic member when the member is wound. This produces significant compressive force and torque to the retaining structures that propagate these adverse effects. By isolating the elastic drive mechanism from traditional rearward fixed contact points on the fuselage, the detrimental consequences of these elastic forces are eliminated. As illustrated in FIG. 1, an elastic motor drive assembly 102 is used to power a model aircraft 100. The self-contained elastic drive assembly 102 shown includes propeller 104 that is driven by the elastic energy stored in the twisting of the rubber band 114. The rubber band 114 is connected to the propeller 104 through propeller drive shaft 106 that is fixed to the propeller 104 in the forward end, and incorporates a front rubber band retainer 112 to engage rubber band 114. The rubber band 114 is fixed at the opposite (rearward) end by a rear rubber band retainer 120 that is fixed within rear retainer mount 118.

The rear retainer mount 118 is held in a fixed position at the near the terminus (end) relative to propeller 104 by a motor isolation span or motor isolation tube 116 and by a front retainer mount and drive shaft bearing 108. The motor isolation tube 116 is a rigid member acting to provide resistive force that maintains distance and imparts anti-rotational counterforce when rubber band 114 is charged with elastic potential energy by rotating propeller 104. The front retainer mount and drive shaft bearing 108 allow the propeller 104 and propeller drive shaft 106 to interface with motor isolation tube 116 without interfering with the rotation of the propeller 104, propeller drive shaft 106 and rubber band 114. A nose cone 110 is rigidly connected to the forward end of the motor isolation tube 116 and provides an interface between the elastic motor drive assembly 102 and the model aircraft 100. Motor isolation tube 116 of the elastic motor drive assembly 102 is inserted into motor receptacle shaft 126, within model aircraft 100. The nose cone 110 is secured to motor mount 122 and held rotationally fixed by nose cone retainer support blocks 124. The entire length of motor isolation tube, 116 rearward of the nose cone 110, remains unattached to model aircraft 100, and is allowed to freely accommodate compressive and torsional forces imposed by the twisting of rubber band 114. The motor isolation span is described as a tube in the aforementioned embodiment but may a variety of forms such as a cage, a single beam, a series of beams or the like, as long as the member approximately fixes the distance and rotational orientation of the retainer mounts.

In the above-described embodiment, elastic motor drive assembly 102 forms an independent drive mechanism that does not transfer compressive force between the front retainer mount and drive shaft bearing 108 and the rear retainer mount 118. The elastic motor drive assembly 102 is charged with potential energy by winding propeller 104 in a direction that would provide forward thrust by unwinding. As the propeller 104 is wound, the propeller drive shaft 106 rotates and twists rubber band 114. Upon twisting, the distance between the ends of rubber band 114 wants to decrease under tension, thereby placing a compressive force on the forward and rearward retention means of the elastic member. In addition to this compressive force, this twisting causes an additional rotational counter force on the rear rubber band retainer 120. Each of these forces, when experienced in a traditional aircraft design, is transmitted to the supporting structures of the aircraft. In the current design, these compressive and torsional forces are constrained within the motor isolation tube 116 and isolated from the supporting structures of the aircraft resulting in improved flight characteristics.

Figure 2:
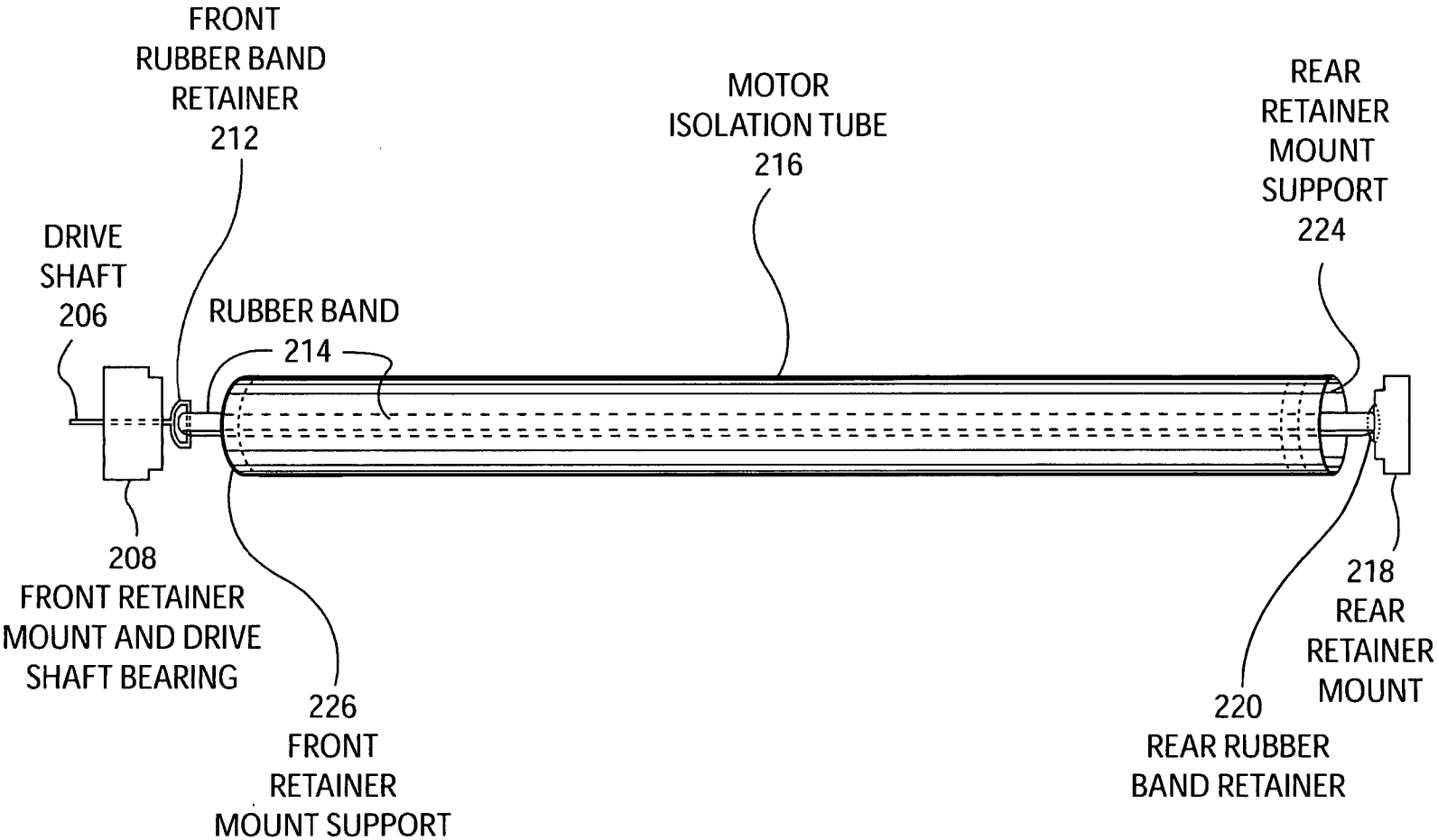
FIG. 2 is a side view illustration of an embodiment of a torque isolating elastic drive mechanism.

FIG. 2 is a side view illustration of an embodiment of a torque isolating elastic drive mechanism. In this embodiment, the entire elastic drive mechanism of the disclosed system is encased in a longitudinal tubular element. This element spans the entire length of the elastic member and acts as the rearward and forward fixed contact points as well as the bearing contact for the propeller mechanism. As an independent mechanism, it is then fixed to the vehicle without producing compression or longitudinal torque to the fuselage at the attachment points. As illustrated in FIG. 2, a self-contained elastic motor drive is used to power a vehicle, such as a model aircraft with a propeller that is driven by the elastic energy stored in twisting of an elastic member. A rubber band 214 is connected at one end to a drive shaft 206 that is used to power a vehicle and incorporates a front rubber band retainer 212 to engage rubber band 214. The rubber band 214 is fixed at the opposite end by a rear rubber band retainer 220 that is fixed within rear retainer mount 218.

The rear retainer mount 218 is held in a fixed position relative to drive shaft 206 by a motor isolation tube 216 and by a front retainer mount and drive shaft bearing 208. The motor isolation tube 216 is a rigid member acting to provide resistive force that maintains distance and imparts anti-rotational counterforce when rubber band 214 is charged with elastic potential energy by rotating the drive shaft 206. The front retainer mount and drive shaft bearing 208 allows the drive shaft 206 to interface with motor isolation tube 216 without interfering with the rotation of the drive shaft 206, and rubber band 214. The front retainer mount and drive shaft bearing 208 engages the forward end (terminus) of the motor isolation tube 216 at the front retainer mount support 226 and the rear retainer mount 218 engages the rearward end (terminus) of the motor isolation tube 216 at the rear retainer mount support 224. Each retainer mount is rigidly secured to the motor isolation tube 216 so that rotational and compressive forces imparted on the retainer supports 224–226 are restrained by the motor isolation tube 216.

The motor isolation tube 216 is secured and held rotationally fixed to a vehicle with a motor mount (not shown). The approximate length of motor isolation tube 216 rearward of the front retainer mount and drive shaft bearing 208, remains unattached the vehicle, and is allowed to freely accommodate compressive and torsional forces imposed by the twisting of the rubber band 214. The elastic motor drive assembly acts as an independent drive mechanism that does transfer compressive force between the front retainer mount and drive shaft bearing 208 and rear retainer mount 218. The elastic motor drive assembly is charged with potential energy by winding the drive shaft 206, rotating, and twisting the rubber band 214. Upon twisting, the distance between the ends of rubber band 214 wants to decrease under tension, thereby placing a compressive force on the forward and rearward retention means of the elastic member. In addition to the compressive force, this twisting causes an additional rotational counter force on the rear rubber band retainer 220. In applications where these compressive and torsional forces are detrimental to the performance of the vehicle, these forces are constrained within the motor isolation tube 216 and isolated from the supporting structures of the vehicle resulting in improved performance characteristics.

Figure 3:
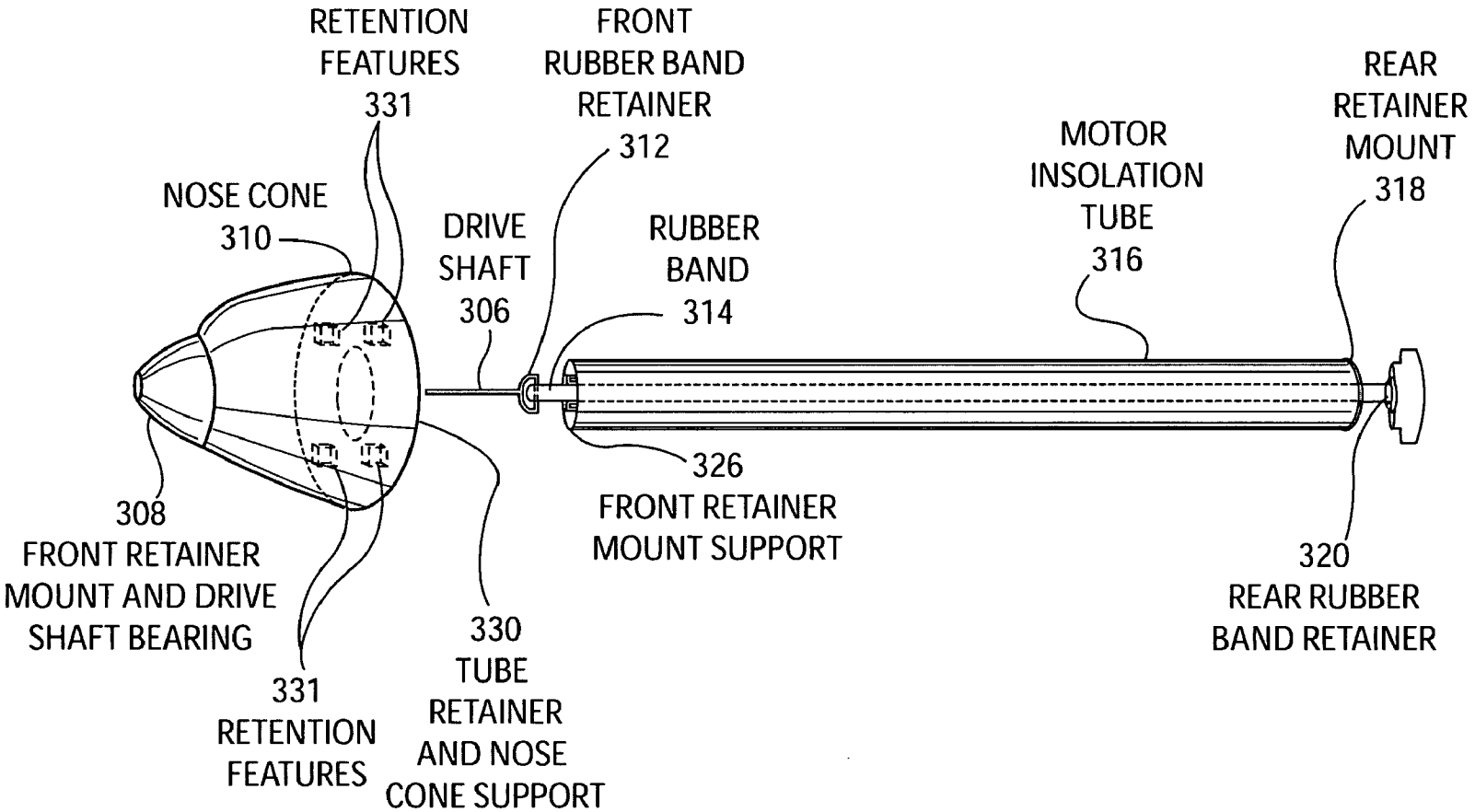
FIG. 3 is an illustration of an embodiment of a torque isolating elastic drive mechanism.

FIG. 3 is a top view illustration of an embodiment of a torque isolating elastic drive mechanism. As illustrated in FIG. 3, a self-contained elastic motor drive is described for use in powering a model aircraft. A rubber band 314 is connected at one end to a drive shaft 306 incorporating a front rubber band retainer 312 to engage rubber band 314. The rubber band 314 is fixed at the opposite end by a rear rubber band retainer 320 that is fixed within rear retainer mount 318. The rear retainer mount 318 his held in a fixed position relative to drive shaft 306 by a motor isolation tube 316 and by a front retainer mount and drive shaft bearing 308. The front retainer mount and drive shaft bearing 308 allows the drive shaft 306 to interface with motor isolation tube 316 without interfering with the rotation of the drive shaft 306 and rubber band 314.

The motor isolation tube 316 is secured and held rotationally fixed to the aircraft with a tube retainer and nose cone support 330 that also connects to the nose cone 310. The approximate length of motor isolation tube 316 rearward of the tube retainer and nose cone support 330, remains unattached the aircraft, and is allowed to freely accommodate compressive and torsional forces imposed by the twisting of rubber band 314. The elastic motor drive interfaces with a model aircraft by rigidly fixing the tube retainer and nose cone support 330 to a motor mount on the front of the aircraft (not shown). This interface may be assisted by the use of alignment and retention features 331 that are keyed to matching features on a motor mount surface of the aircraft to align the elastic motor with the aircraft and act as a torsional restraint to the propeller torque produced during motor discharge.

Figure 4:
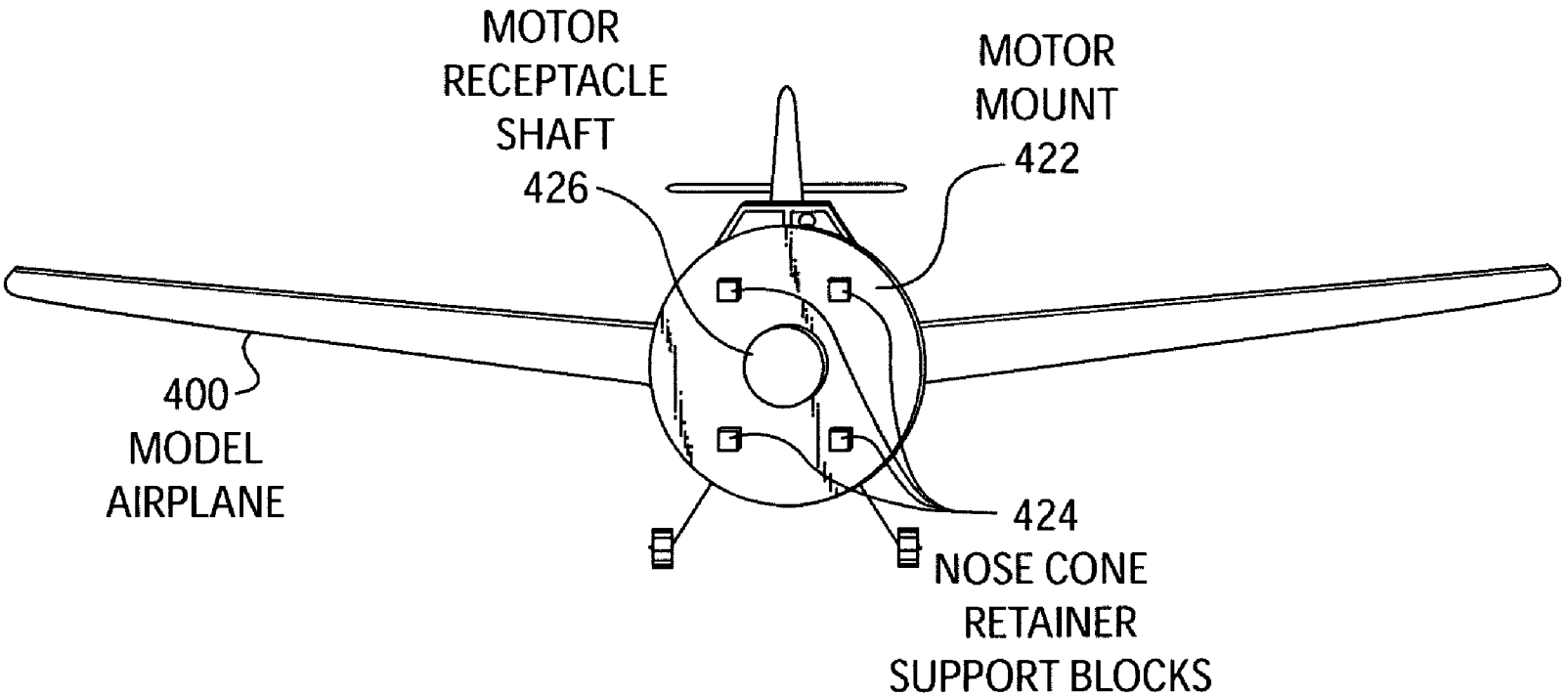
FIG. 4 illustrates an embodiment of a model aircraft application of a torque isolating elastic drive mechanism.

FIG. 4 illustrates an embodiment of a model aircraft application of a torque isolating elastic drive mechanism. As illustrated in FIG. 4, a model airplane 400 is fitted with receiving members for an elastic drive. A motor receptacle shaft 426 is placed on the centerline of the model aircraft 400 and is sized to receive the motor isolation tube (316 of FIG. 3) without interference. The portion of the motor isolation tube that is received by the motor receptacle shaft 426 is not fixed within the shaft and is free to twist and move freely under internal stress created by an elastic member being wound and discharged. The elastic drive is mounted to the model aircraft 400 by rigidly fixing the tube retainer and nose cone support (330 of FIG. 3) to the motor mount 422. Interlocking nose cone retainer blocks 424 are keyed to matching features on the tube retainer and nose cone support to align the fit between the model aircraft 400 and the elastic motor and act as a torsional restraint to the propeller torque produced during motor discharge. The fit between the motor mount 422 and the tube retainer and nose cone support can be accomplished with a variety of mechanisms such as a frictional interference fit, permanent or temporary adhesives, mechanical fasteners or the like.

Figure 5:
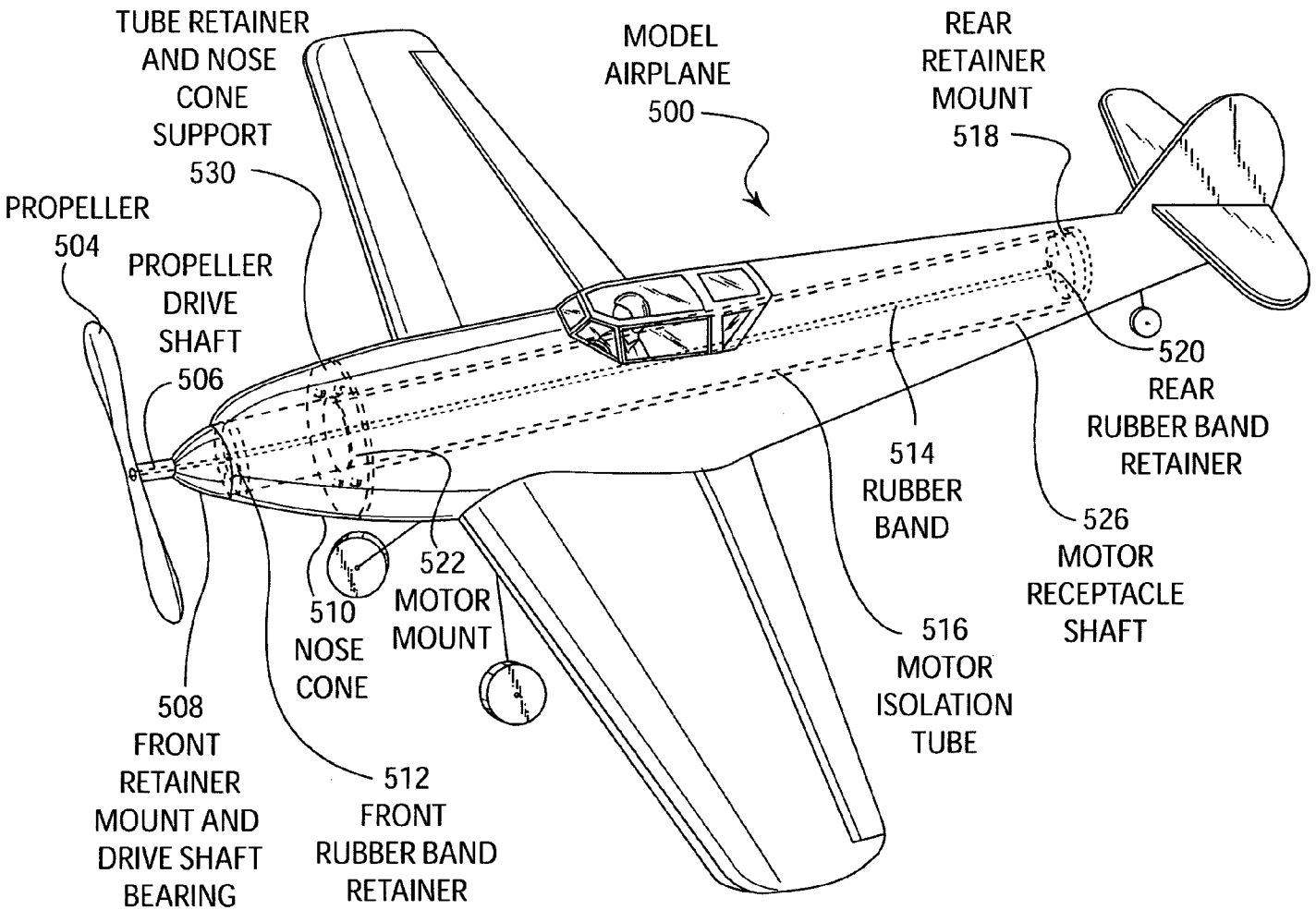
FIG. 5 illustrates an embodiment of a torque isolating elastic drive mechanism incorporated within a model aircraft.

FIG. 5 illustrates an embodiment of a torque isolating elastic drive mechanism incorporated within a model aircraft. As illustrated in FIG. 5, an elastic motor drive assembly is incorporated within model aircraft 500 to provide thrust. The self-contained elastic drive assembly 500 incorporated within the vehicle includes propeller 504 that is driven by the elastic energy stored in twisting of rubber band 514. The rubber band 514 is connected to the propeller 504 through propeller drive shaft 506 that is fixed to the propeller 504 in the forward end, and incorporates a front rubber band retainer 512 to engage rubber band 514. The rubber band 514 is fixed at the opposite end by a rear rubber band retainer 520 that is fixed within rear retainer mount 518.

The rear retainer mount 518 is held in a fixed position relative to propeller 504 by a motor isolation tube 516 and by a front retainer mount and drive shaft bearing 508. The front retainer mount and drive shaft bearing allows the propeller 504 and propeller drive shaft 506 to interface with motor isolation tube 516 without interfering with the rotation of propeller 504, propeller drive shaft 506 and rubber band 514. A nose cone 510 is rigidly connected to the forward end of the motor isolation tube 516 and is connected to the tube retainer and nose cone support 530 that provides an interface between the elastic motor drive assembly and the model aircraft 500. Motor isolation tube 516 of the elastic motor drive assembly is fitted within motor receptacle shaft 526, within model aircraft 500. The tube retainer and nose cone support 530 is secured and held rotationally fixed to motor mount 522. The entire length of motor isolation tube 516, rearward of the tube retainer and nose cone support 530, remains unattached to model aircraft 500, and is allowed to freely accommodate compressive and torsional forces imposed by the twisting of rubber band 514.

In this manner, the compressive force between the front retainer mount and drive shaft bearing 508 and rear retainer mount 518 is isolated from the model aircraft 500. The elastic motor drive assembly is charged with potential energy by winding propeller 504 in a direction that would provide forward thrust by unwinding. As the propeller 504 is wound, the propeller drive shaft 506 rotates and twists rubber band 514. Upon twisting, the distance between the ends of rubber band 514 tends to decrease, thereby placing a compressive force on the forward and rearward retention means of the elastic member. In addition to the compressive force, this twisting causes an additional rotational counter force on the rear rubber band retainer 520. Each of these forces, when experienced in a traditional aircraft design, is transmitted to the supporting structures of the aircraft and the flight control surfaces causing detriment to the flight dynamics. In the current design, these compressive and torsional forces are constrained within the motor isolation tube 516 and isolated from the supporting structures of the aircraft resulting in improved aerodynamics and flight characteristics.

Various embodiments of the aforementioned system may be realized in different form than described in the descriptions and drawings shown. For example, various vehicles or other devices such as model cars, boats, trains or other kinetic instruments may utilize the benefits of a force isolated elastic motor drive. In particular, the embodiments described herein provide an elastic drive mechanism for a model aircraft that provides force isolation so that the compressive force of the rubber band that is placed in tension when wound does not impart that tension to the structural members of the aircraft that would be transmitted to deformation or misalignment of the flight control surfaces. Additionally, the described device also provides torque isolation between the drive mechanism and the structural members of the aircraft with the same result. This force isolation is realized in the performance of the model aircraft in longer and more controlled flights.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A system that isolates internal forces from adversely influencing propulsion of a vehicle comprising:

an elastic member for storing potential energy for later use as rotational kinetic energy;

a front retainer for retaining a forward end of said elastic member;

a drive shaft connected to said front retainer that transmits rotation of said front retainer to said drive shaft;

a drive shaft bearing within said front retainer that retains said drive shaft and allows rotation of said drive shaft;

a rear retainer for retaining a rearward end of said elastic member; and, a motor isolation span that spans the length of said elastic member and rigidly retains said front retainer near a forward terminus and said rear retainer near an opposing rearward terminus to restrain compressive and torsional forces created by said elastic member during said storing of said potential energy and said release as rotational kinetic energy.

2. A system of claim 1 wherein said elastic member is a rubber band.

3. A system of claim 1 wherein said vehicle is a model aircraft.

4. A system of claim 3 wherein said rotational kinetic energy is used to rotate a propeller that provides thrust for said propulsion of said model aircraft.

5. A system of claim 1 wherein said drive shaft and said front retainer are incorporated within a single part.

6. A system of claim 1 that can be installed and removed from said vehicle as a single module.

7. A system for a model aircraft that isolates internal forces from adversely influencing aerodynamics if said model aircraft comprising:

a rubber band for storing potential energy for later use as rotational kinetic energy;

a front retainer for retaining a forward end of said rubber band;

a drive shaft connected to said front retainer that transmits rotation of said front retainer to said drive shaft;

a drive shaft bearing within said front retainer that retains said drive shaft and allows rotation of said drive shaft;

a rear retainer for retaining a rearward end of said rubber band; and, a motor isolation span that spans the length of said rubber band and rigidly retains said front retainer near a forward terminus and said rear retainer near an opposing rearward terminus to restrain compressive and torsional forces created by said rubber band when twisted to store said potential energy and when released as rotational kinetic energy to rotate a propeller that provides thrust for said propulsion of said model aircraft.

8. A system of claim 7 wherein said drive shaft and said front retainer are incorporated within a single part.

9. A system of claim 7 that can be installed and removed from said vehicle as a single module.

10. A model aircraft powered by a system that isolates the internal forces from adversely influencing aerodynamics of said model aircraft comprising:

a model aircraft; and, an elastic drive motor within said model aircraft comprising:

a rubber band for storing potential energy for later use as rotational kinetic energy comprising;

a front retainer for retaining a forward end of said rubber band;

a drive shaft connected to said front retainer that transmits rotation of said front retainer to said drive shaft;

a drive shaft bearing within said front retainer that retains said drive shaft and allows rotation of said drive shaft;

a rear retainer for retaining a rearward end of said rubber band; and, a motor isolation span that spans the length of said rubber band and rigidly retains said front retainer near a forward terminus and said rear retainer near an opposing rearward terminus to restrain compressive and torsional forces created by said rubber band when twisted to store said potential energy and when released as rotational kinetic energy to rotate a propeller that provides thrust for said propulsion of said model aircraft.

11. A model aircraft of claim 10 wherein said drive shaft and said front retainer are incorporated within a single part.

12. A model aircraft of claim 10 wherein said elastic drive motor can be removed from and installed on said vehicle as a single module.

13. A method of propelling a vehicle with an elastic drive motor that isolates internal forces from adversely influencing movement of said vehicle comprising the steps of:

retaining a forward end of an elastic member with a front retainer that is connected to a drive shaft;

transmitting rotation of said front retainer to said drive shaft;

retaining a rearward end of said elastic member with a rear retainer;

retaining said drive shaft with a drive shaft bearing within said front retainer that allows rotation of said drive shaft;

rigidly retaining said front retainer near a forward terminus of a motor isolation span and said rear retainer near an opposing a rearward terminus of said motor isolation span that spans the length of said elastic member;

storing potential energy by twisting said elastic member;

isolating compressive and torsional forces with said motor isolation span that are created by restraining said elastic member;

releasing said potential energy of said elastic member as rotational kinetic energy to propel said vehicle; and, isolating compressive and torsional forces from with said motor isolation span created by releasing said elastic member and producing said rotational kinetic energy.

14. A method of claim 13 wherein said step of releasing said potential energy of said elastic member as rotational kinetic energy to propel said vehicle further comprises:

utilizing said rotational kinetic energy is used to rotate a propeller that provides thrust to a model aircraft.

15. A method of providing thrust to a model aircraft with a rubber band drive motor that isolates internal forces from adversely influencing aerodynamics of said model aircraft comprising the steps of:

retaining a forward end of a rubber band with a front retainer that is connected to a drive shaft;

transmitting rotation of said front retainer to said drive shaft;

retaining a rearward end of said rubber band with a rear retainer;

retaining said drive shaft with a drive shaft bearing within said front retainer that allows rotation of said drive shaft;

rigidly retaining said front retainer near a forward terminus of a motor isolation span and said rear retainer near an opposing a rearward terminus of said motor isolation span that spans the length of said elastic member;

storing potential energy by twisting said rubber band;

isolating compressive and torsional forces with said motor isolation span that are created by restraining said rubber band;

releasing said potential energy of said elastic member as rotational kinetic energy to rotate a propeller that provides thrust to said model aircraft; and, isolating compressive and torsional forces from with said motor isolation span created by releasing said rubber band.

* * * * *